US012209407B1

(12) United States Patent
Laydera-Collins

(10) Patent No.: US 12,209,407 B1
(45) Date of Patent: Jan. 28, 2025

(54) NARROW GAP FILLING STRUCTURE

(71) Applicant: Gordon Sales, Inc., Bossier City, LA (US)

(72) Inventor: Imack Laydera-Collins, Benton, LA (US)

(73) Assignee: Gordon Sales, Inc., Bossier City, LA (US)

( * ) Notice: Subject to any disclaimer, the term of this patent is extended or adjusted under 35 U.S.C. 154(b) by 55 days.

(21) Appl. No.: 17/578,967

(22) Filed: Jan. 19, 2022

Related U.S. Application Data

(60) Provisional application No. 63/139,457, filed on Jan. 20, 2021.

(51) Int. Cl.
*E04B 1/68* (2006.01)

(52) U.S. Cl.
CPC ..... *E04B 1/6803* (2013.01)

(58) Field of Classification Search
CPC ..... E04B 1/6803
USPC ..... 52/272
See application file for complete search history.

(56) References Cited

U.S. PATENT DOCUMENTS 2,097,988 A * 11/1937 Ross ..... E04B 1/24 52/287.1
2,882,561 A * 4/1959 Shrode ..... E06B 3/60 52/455
3,188,695 A * 6/1965 Spangenberg ..... E04B 9/0485 52/272
3,270,474 A * 9/1966 Driggers ..... E04B 1/6803 52/396.04
3,274,739 A * 9/1966 Gregoire ..... E04D 3/30 52/287.1
3,286,422 A * 11/1966 Pangerl ..... E04F 19/0463 52/288.1
3,292,321 A 12/1966 Schans
3,331,171 A * 7/1967 Hallock ..... E04B 1/68 52/396.04
3,376,678 A * 4/1968 Thygeson, Sr. ..... E04B 1/76 52/471
3,378,973 A * 4/1968 Tudor-Pole ..... F16B 5/125 52/287.1
3,386,216 A 6/1968 Zwickert
3,439,463 A * 4/1969 Matarese ..... E04B 1/6803 52/287.1
3,479,768 A * 11/1969 Smadja ..... E06B 3/4681 52/716.5
3,505,773 A * 4/1970 Thomas ..... E04F 19/04 52/288.1

(Continued)

FOREIGN PATENT DOCUMENTS

CN 113463808 A * 10/2021 ..... E04D 13/04
DE 4030117 A1 * 3/1992 ..... E04B 9/30

(Continued)

*Primary Examiner* — Brian D Mattei
*Assistant Examiner* — Joseph J. Sadlon
(74) *Attorney, Agent, or Firm* — Jones Walker LLP

(57) ABSTRACT

A gap filler assembly for covering a gap between two surfaces, for example, a partition wall end and a window mullion. The gap filler assembly includes an elongated filler member having (i) a first leg, and (ii) a second leg on an interior side of the first leg and extending from the first leg. A spring retainer is positioned on an interior side of the first leg and a spring is connected to the spring retainer. A gasket is positioned on an exterior side of the second leg.

18 Claims, 8 Drawing Sheets

(56) References Cited

U.S. PATENT DOCUMENTS 3,696,575 A * 10/1972 Armstrong ..... E04B 1/6804 52/395
3,707,061 A * 12/1972 Collette ..... E04F 19/0463 24/336
3,800,489 A * 4/1974 Boice ..... E04F 19/0495 52/762
3,821,869 A * 7/1974 Morgan ..... E04B 1/043 52/287.1
3,864,886 A * 2/1975 Thom ..... E04B 1/6804 52/396.04
3,925,952 A * 12/1975 Hagel ..... E04B 1/08 52/235
3,967,420 A 7/1976 Papsco
4,086,734 A 5/1978 Hayashi
4,205,498 A 6/1980 Unayama
4,539,243 A * 9/1985 Miller ..... E06B 3/5857 52/844
4,608,796 A * 9/1986 Shea, Jr. ..... E06B 3/66314 52/786.13
4,781,003 A * 11/1988 Rizza ..... E04B 1/6815 404/69
4,858,406 A * 8/1989 Lane ..... E04F 19/02 52/58
4,926,594 A * 5/1990 Sampson ..... E04D 13/0305 52/656.5
4,946,484 A * 8/1990 Monson ..... F24F 13/28 55/385.2
5,060,439 A * 10/1991 Clements ..... E04B 1/6815 404/54
5,088,256 A * 2/1992 Face, Jr. ..... E01C 11/123 52/396.04
5,117,587 A * 6/1992 Doan ..... E06B 7/2312 49/495.1
5,259,162 A * 11/1993 Nicholas ..... E04B 1/681 52/468
5,356,675 A * 10/1994 Unger ..... E04B 1/0046 52/786.13
5,365,713 A * 11/1994 Nicholas ..... E04B 1/681 52/573.1
5,410,853 A * 5/1995 Hartleif ..... E04B 9/064 52/506.07
5,524,402 A 6/1996 Sykes
5,666,775 A * 9/1997 Shreiner ..... E04B 1/6803 52/573.1
5,740,644 A * 4/1998 Menchetti ..... E04F 17/005 52/489.1
5,791,105 A * 8/1998 Gangi ..... E06B 3/5427 52/489.1
5,802,789 A * 9/1998 Goodman ..... A47B 83/001 52/239
5,893,247 A * 4/1999 Hickman ..... E04D 3/405 52/60
6,351,915 B1 3/2002 Puckett
6,360,504 B1 * 3/2002 Webb ..... E04D 3/405 52/60
6,807,781 B2 * 10/2004 Trout ..... E04F 21/00 52/846
7,435,134 B2 * 10/2008 Lenox ..... F24S 25/20 52/173.3
7,451,574 B2 * 11/2008 Spek ..... E04F 19/0436 52/718.01
7,592,537 B1 * 9/2009 West ..... F24S 25/61 136/251
8,037,652 B2 * 10/2011 Marshall ..... E02D 27/02 52/564
8,572,914 B2 11/2013 Burgess
8,782,977 B2 7/2014 Burgess
8,789,329 B2 * 7/2014 Radoane ..... E04B 2/88 52/746.1
9,103,121 B2 * 8/2015 Brughuis ..... E04H 12/12
9,431,953 B2 * 8/2016 Stearns ..... H02S 30/00
9,644,377 B1 * 5/2017 Massotte ..... E04C 5/168
9,745,791 B1 * 8/2017 Rohovit ..... E06B 7/26
9,963,875 B1 * 5/2018 Prygon ..... E04C 2/528
10,458,453 B1 * 10/2019 Galligan ..... E04B 1/6807
10,494,811 B1 12/2019 Gussenbauer et al.
10,689,850 B2 * 6/2020 Langeveld ..... E04B 9/26
10,954,669 B2 * 3/2021 Sander ..... E04B 1/7038
11,306,476 B2 * 4/2022 Griffith ..... E04B 1/6812
11,451,187 B2 * 9/2022 Eriksson ..... F24S 25/636
11,486,137 B2 11/2022 Klein et al.
11,549,256 B2 * 1/2023 Sander ..... E04B 1/7038
2002/0157335 A1 10/2002 Vos
2004/0216398 A1 11/2004 Manos et al.
2005/0155312 A1 * 7/2005 Friday ..... E04F 19/0436 52/716.1
2006/0196144 A1 * 9/2006 Spek ..... E04B 9/30 52/716.1
2007/0283640 A1 * 12/2007 Shivak ..... E05D 15/063 52/207
2008/0263981 A1 * 10/2008 O'Brien ..... E04F 15/14 52/396.02
2009/0025314 A1 * 1/2009 Komamine ..... F24S 25/61 52/173.3
2012/0180414 A1 7/2012 Burgess
2013/0097948 A1 * 4/2013 Burgess ..... E04B 2/7409 52/232
2016/0111997 A1 * 4/2016 Ganshaw ..... F24S 25/61 248/224.7
2017/0234004 A1 8/2017 Pilz
2019/0218774 A1 7/2019 Danesi et al.
2019/0316348 A1 10/2019 Pilz et al.
2021/0108410 A1 4/2021 Pring
2021/0363750 A1 11/2021 Picchio
2022/0098888 A1 3/2022 Richard

FOREIGN PATENT DOCUMENTS

FR 3074507 A1 * 6/2019 ..... E04B 1/6803
GB 1405912 A * 9/1975 ..... E04B 1/6162

* cited by examiner

NARROW GAP FILLING STRUCTURE

CROSS-REFERENCE TO RELATED APPLICATION

This application claims the benefit under 35 USC § 119 (e) of U.S. Provisional Application No. 63/139,457 filed Jan. 20, 2021, which is incorporated by reference herein in its entirety.

FIELD OF THE INVENTION

The present invention finds its field of application in the architectural and building construction industry, where the invention may be utilized to fill gaps between walls and windows, partition walls, perimeter walls, and the like, for purposes of privacy and reduction of sound transmission from separated spaces.

BACKGROUND OF THE INVENTION

Modern commercial buildings are designed to fit a diversity rooms and partition arrangements aiming to accommodate specific requirements for occupants. As such, when adding partitions there are conditions that will not allow construction of partition walls in direct contact with exterior windows or other exterior structures. Many commercial buildings have an exterior façade composed of large glass windows supported by a metallic structure. The metallic structure also serves as frames for the large windows. Many builders select the vertical elements of the window frames to align with the partition walls in order to avoid ending the walls facing a glass pane, which will degrade the outside aesthetic of the building façade. When adding a partition wall to these large spaces, the wall is positioned directly in front of the vertical window frame structural element, i.e., window mullion. Since in many instances, the wall cannot be extended to be in contact with the window mullion, the resulting gap is filled with an elongated structure that covers the gap between the window mullion and the partition wall end, or if the wall does end adjacent to a window pane, then between the window pane and the partition wall end. These gap fillers achieved two purposes: (1) to create an aesthetically pleasant joint, and (2) to prevent transmission of sound through the gap. The latter is particularly relevant given recent trends focusing on increased privacy, thus raising the requirements for sound absorption by these gap filling structures.

Since the windows move due to external wind forces, there is motion by the window frame relative to the partition wall. Therefore, the gap filling structure should have some degree of elasticity to allow for frame motion without adding additional loads to the partition walls. Some attempted prior art solutions use a foam type element that is wedged into the gap. Other attempted solutions provide rigid elements that are custom made for specific gaps or are attached to the faces of the wall projecting into the gap. However, due to the diverse configuration of curtain walls and window frames, there is a need for a gap filler device that is resilient, aesthetically pleasant, and capable of blocking the noise transmission from room to room for privacy requirements.

BRIEF SUMMARY OF THE INVENTION

One object of the present invention is the implementation of an architectural gap filler that is resilient and adjustable enough to fit a specific range of gap openings. It would also be advantageous for this device to be aesthetically pleasant, durable, easy to install, and capable of blocking the speech range of sound transmission though the gap. A preferred embodiment of the gap filling assembly of the present invention is comprised of a single elongated extruded element that supports a sealing gasket and a holding leaf spring. The leaf spring functions as a friction retainer, as well as a compressing force element that pushes the sealing gasket against one of the vertical boundaries of the wall gap. Also, the leaf spring provides a range of compression space which allows the gap filler assembly to accommodate a certain range of gaps. The gap filler assembly allows relative movement of the exterior wall relative to the partition wall by further deflection of the leaf spring. The gap filler assembly also has an elongated portion that covers the gap between the leaf spring and the supporting surface. These details and other features of selected embodiments of the present invention will be more fully described by the detailed description supported by the appended drawings.

BRIEF DESCRIPTION OF THE DRAWINGS

The accompanying figures, where like reference numerals refer to identical or functionally similar elements throughout separate views, which are not to true scale, and which together with the detailed description below, are incorporated in and form part of the specification, serve to illustrate certain principles and advantages according to the present invention.

DETAILED DESCRIPTION OF THE INVENTION

According to one preferred embodiment of the present invention, there is described a building structure comprising an exterior façade consisting of a curtain wall, where the curtain wall is constructed with glass panels supported by a metal structure. The metal structure has vertical and horizontal members known in the industry as window mullions. This building structure will also include interior partition walls having end faces aligned in the front of the vertical window mullions. Due to certain structural limitations, the end of the partition wall facing the exterior curtain wall may not be able to touch the glass panels or the window mullions, leaving a gap. This gap allows sound and air to travel from one building space to reach the adjacent space separated by the partition wall.

Figure 1:
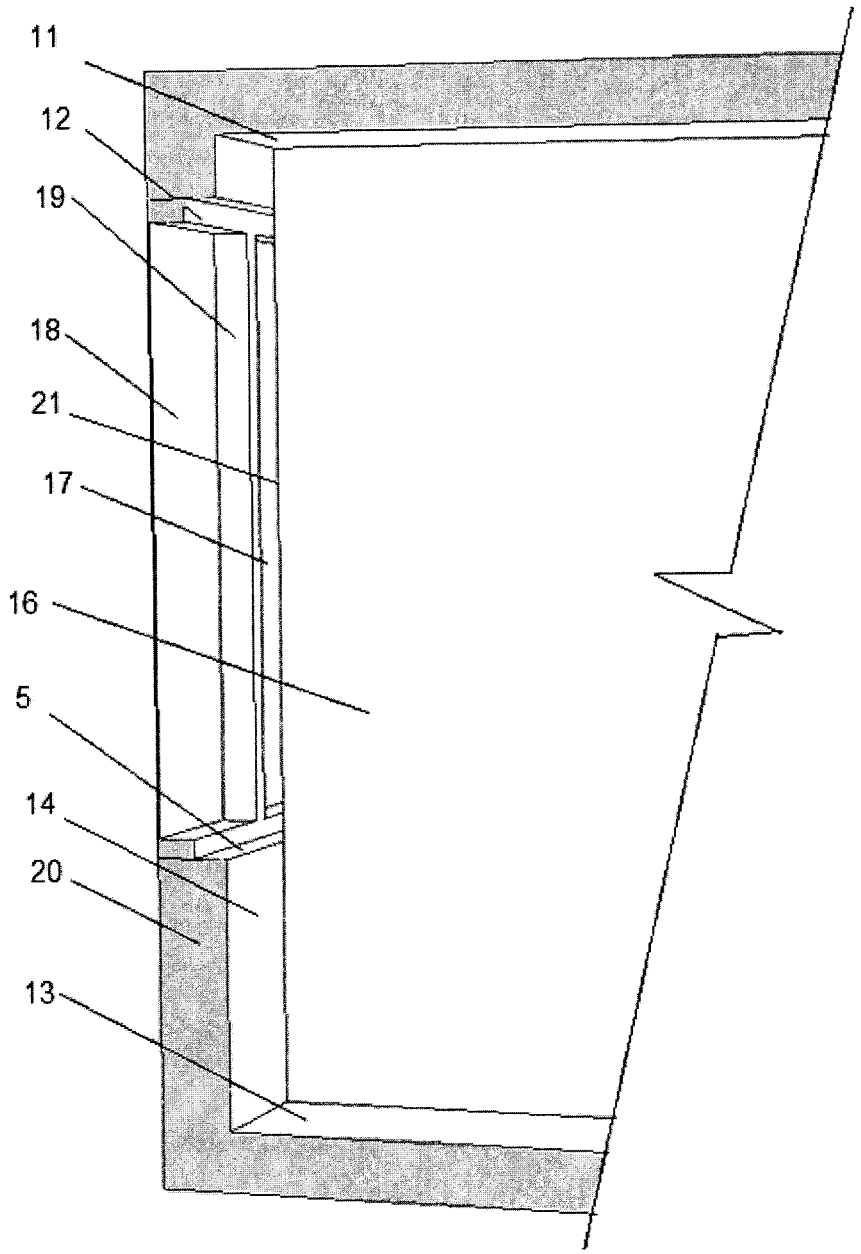
FIG. 1 shows a typical structural environment where the gap filler assembly encounters its application.

FIG. 1 shows a perspective view of these typical construction elements, including a window peripheral frame 12 which is attached to the structure of the building 20, and the glass panes 18 held between the window mullions 19 and 12. When the partition wall 16 is constructed, it is built in contact with the base wall 14, leaving a gap 17 between the window mullions 19, and the end face 21 of the partition wall 16 facing the curtain wall window 18. This gap 17 is typically filled with a gap filling assembly that fully isolates the spaces on both sides of the partition wall 16. These spaces require full privacy protection, therefore, the gap filling assemblies are required to block most of the speech frequency sound passing between rooms. The gap filling materials or assemblies should aesthetically blend with the construction finish, have thermal and acoustical insulation properties, have anti-seismic properties, compensate for thermal expansion between the exterior wall and the interior wall, and absorb the exterior curtain wall deformations caused by wind loads. In addition to these requirements, the gap filler assembly should be easy to install and be durable.

Figure 2:
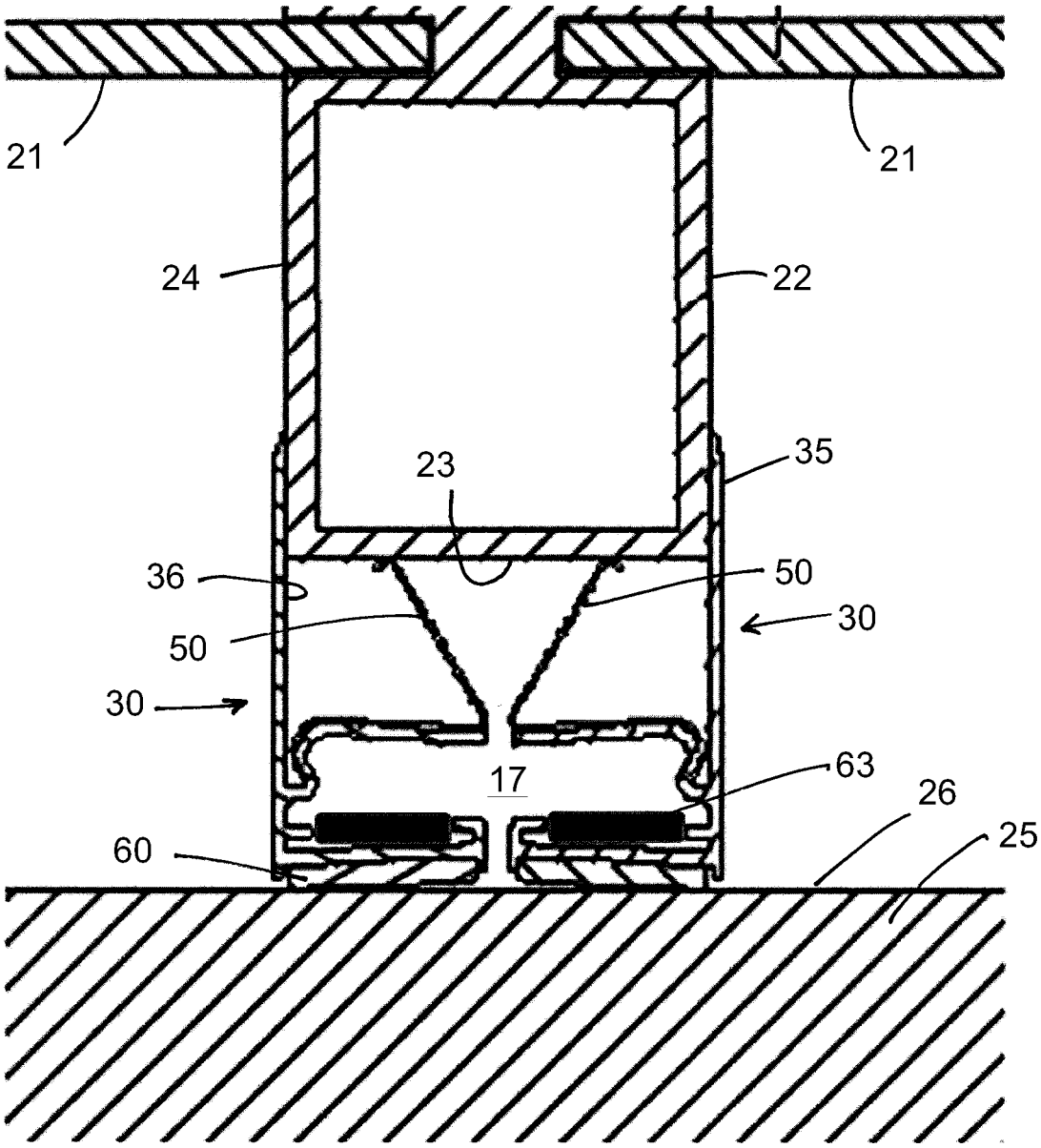
FIG. 2 is a cross sectional view of the gap filler assembly showing a typical application for filling a small gap between a partition wall and a window mullion.

FIG. 2 depicts the installed condition of one embodiment of the gap filler assembly of the present invention. FIG. 2 shows a partition wall 25 having an inner face 26. Positioned across from the inner face 26 of the partition wall 25 is an exterior curtain wall with glass panels 21, held in place by window mullions 22. The space between the window mullion face 23 and the partition wall face 26 delimit the gap 17. To cover the gap 17, the gap filler assemblies 30 are located on both sides of the window mullion 22. Of course, if only one side of the gap (i.e., one room) requires an aesthetic finish of the gap 17, then a gap filler assembly 30 will be only positioned over that side of the gap.

Figure 3:
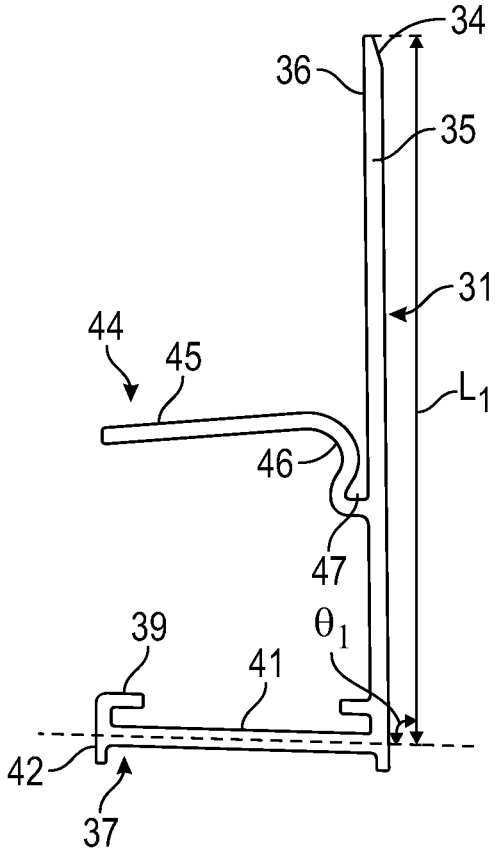
FIG. 3 is a cross sectional view of an elongated L-shaped filler member.
Figure 5:
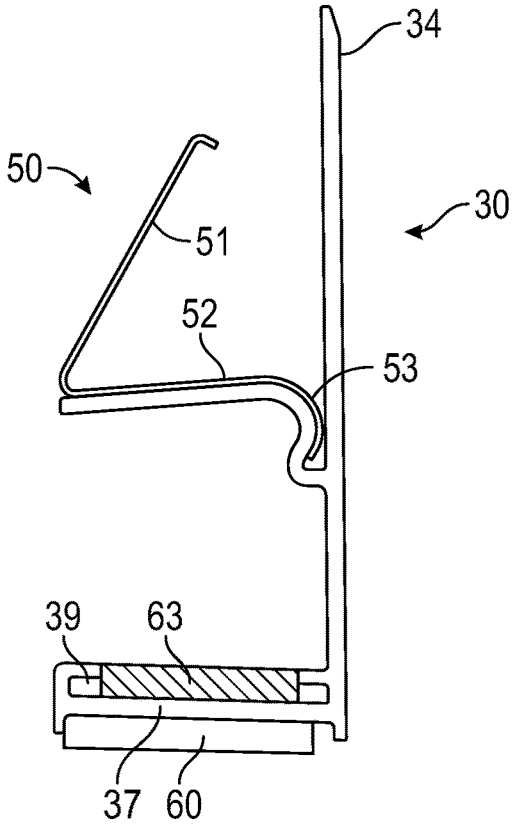
FIG. 5 is a cross sectional view of one embodiment of the gap filler assembly of the present invention illustrating its main components.
Figure 6:
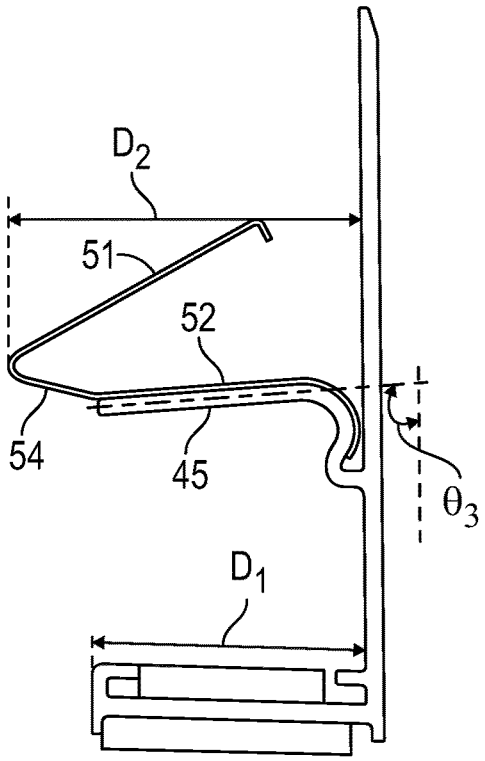
FIG. 6 is a cross sectional view of another embodiment of the gap filler assembly.

FIGS. 3 and 5 show the gap filler assemblies 30 in more detail. FIG. 3 is a cross section of the main structural feature of the gap filler assembly 30, L-shaped filler member 31. L-shape filler member 31 includes a major leg 34 and a minor leg 37. Major leg 34 includes an exterior side or face 35 and an interior side or face 36. As seen in FIG. 2, the exterior side 35 is the portion of the gap filler assembly that is visible from the exterior of the gap. Returning to FIG. 3, on the interior side 36 of major leg 34 is positioned a spring retainer 44. This embodiment of spring retainer 44 includes the spring support tongue 45 and spring holding loop 46 which ultimately forms pocket 47 where it joins with major leg 34. In the FIG. 3 embodiment, the spring support tongue 45 extends away from major leg 34 approximately the same distance as does minor leg 37. In other embodiments, spring support tongue 45 extends at least 75% of this distance, and there could also be still further embodiments where the spring support tongue extends less than 75% of this distance. As seen in FIG. 6, the spring support tongue 45 is inclined relative to the major leg 34 to obtain the maximum compression of the leaf spring segments 51 and 52 without interfering with the bend 54. This angle of inclination $\theta_3$ of spring support tongue 45 depends on the bending radius of the leaf spring bend 54 and could be between 90° and 80°.

Figure 4:
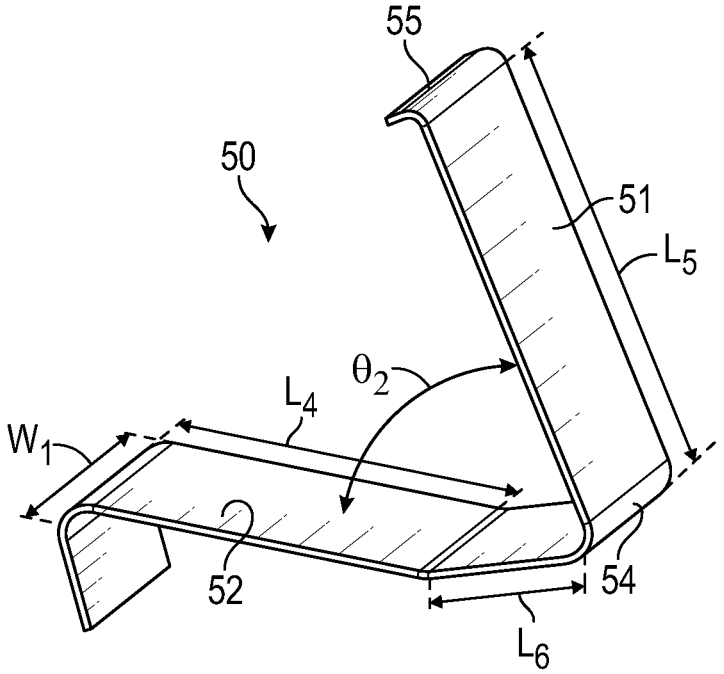
FIG. 4 is an isometric view of one spring type used in the gap filler assembly.
Figure 7:
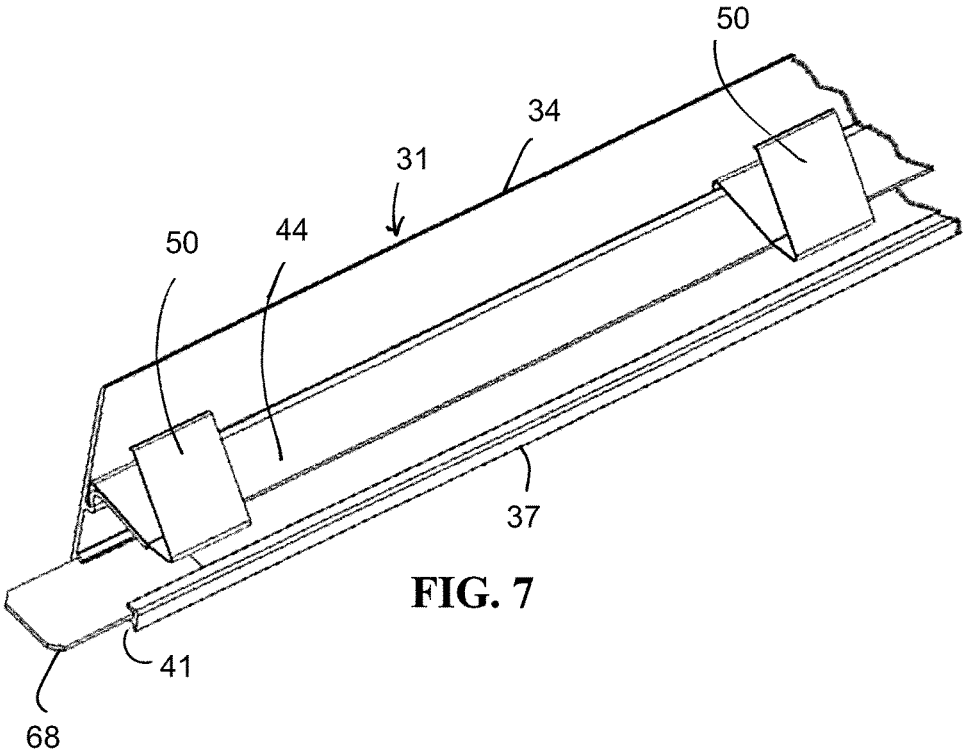
FIG. 7 is an isometric view showing the elongated extruded element of the gap filler assembly with the vibration dampening strip and leaf springs.

The minor leg 37 in the FIG. 3 embodiment extends away from the interior side 36 of major leg 34 forming an interior angle $\theta_1$ relative to major leg 34 of slightly less than 90°, for example 80° to 89°, and more preferably 85° to 89°. However, in other embodiments, angle $\theta_1$ could be 90°. Minor leg 37 includes two inwardly extending (i.e., inwardly toward the center of minor leg 37) retaining tabs 39 which form the splice pocket 41 (explained in more detail below). FIG. 5 suggests how some embodiments will position a vibration dampening material 63 between retaining tabs 39 Examples of such vibration dampening material could include mass loaded vinyl and functionally equivalent materials. Similarly, FIG. 5 illustrates how this embodiment will include the gasket 60 positioned between outwardly (i.e., perpendicular to the length of minor leg 37) extending tabs 42. Example materials for gasket 60 could include various polymer foams (e.g., polyurethane forms) with a rigidity allowing at least some deformation when engaging the face of the partition wall. While FIGS. 3 and 4 show the cross section of L-shaped filler member 31, FIG. 7 illustrates the elongated nature of L-shaped filler member 31. In preferred embodiments, L-shaped filler member 31 may be manufactured as an aluminum extrusion or a thermo-plastic extrusion in the cross sectional profile seen in the figures, but less preferred embodiments could manufacture the L-shaped filler members from different materials and processes, such as brake forming which somewhat will change the structures obtained from extruded forms.

FIG. 5 illustrates one embodiment of a leaf spring 50 which may be used in conjunction with the L-shaped filler member 31. Leaf spring 50 will include a second segment 52 extending along spring supporting tongue 45 which terminates with the spring loop 53 engaging spring holding loop 46 and pocket 47 to become fixed therein. A first spring segment 51 will fold back toward the interior side 36 of major leg 34. FIGS. 4 and 6 illustrate a slightly modified embodiment of leaf spring 50. As suggested in FIG. 6, this embodiment of leaf spring 50 includes a middle segment 54 which extends beyond spring support tongue 45 and angles slightly upward and away from support tongue 45. In the FIG. 4 embodiment, leaf spring 50 may be constructed from any suitable spring metal, including wire forms, with a preferred embodiment being a tempered stainless steel sheet metal. The length of the spring segments may vary depending on the width of the mullion face (or other end wall surface) which the gap filler assemblies are designed to engage and the required spring back of the leaf spring to provide the necessary force over a range of openings. Since the length of arms of the leaf spring determines the distance between the leaf spring tip 55 and the spring second segment 52, for an equal angle of deformation $\theta_2$, the arms L5, L4 and L3 may be extended to obtain a greater range of spring force. In many examples, first and second segments 51 and 52 will have a length ($L_5$ and $L_4$) of between 1" and 3". The width of the leaf spring "$W_1$" is another parameter determining the force exerted by the spring, and in a preferred embodiment, the width "$W_1$" could be approximately 1" for practical purposes As referenced above, FIG. 2 shows the installed condition of the FIG. 5 embodiment of the gap filler assembly 30. It can be seen how the opposing gap filler assemblies 30 are held in position by the expansive force of the leaf springs 50 acting on mullion inner face 23, which creates a frictional force between the tip of the leaf spring 50 in contact with the mullion face 23. Also, the spring force is applied in the opposite direction over the end face 26 of the partition wall 25 where the body of the L-shaped filler member 31 pushes the gasket 60 against the face 26 of the partition wall 25. The inner face 36 of the L-shaped filler members 31 are in contact with the side faces 24 of the window mullion 22. Since the distance between the window mullion inner face 23 and the partition wall inner face 26 could be reduced due to wind force over the exterior wall, the leaf spring 50 can deflect angularly to allow for this motion.

Viewing FIG. 7, it can be envisioned how the gaskets 60 and the vibration dampening strip 63 are placed along the length of the L-shaped filler member 31. On the other hand, the leaf springs 50 are spaced at intervals along the length of spring retainer 44 to provide the required holding force against the mullion face 23 (see FIG. 5) along the entire length of gap 17. FIG. 7 also shows a splice tongue 68 engaging the splice pocket 41. If multiple gap filler assemblies 30 are require to cover an unusually long gap, a splice tongue 68 can engage the splice pockets of abutting gap filling assemblies to ensure alignment between adjacent assemblies. In a preferred embodiment, the springs will be spaced apart at a distance such that they exert force of between about 4 and 10 pounds per linear foot along the length of the gap filler assemblies.

Figure 8:
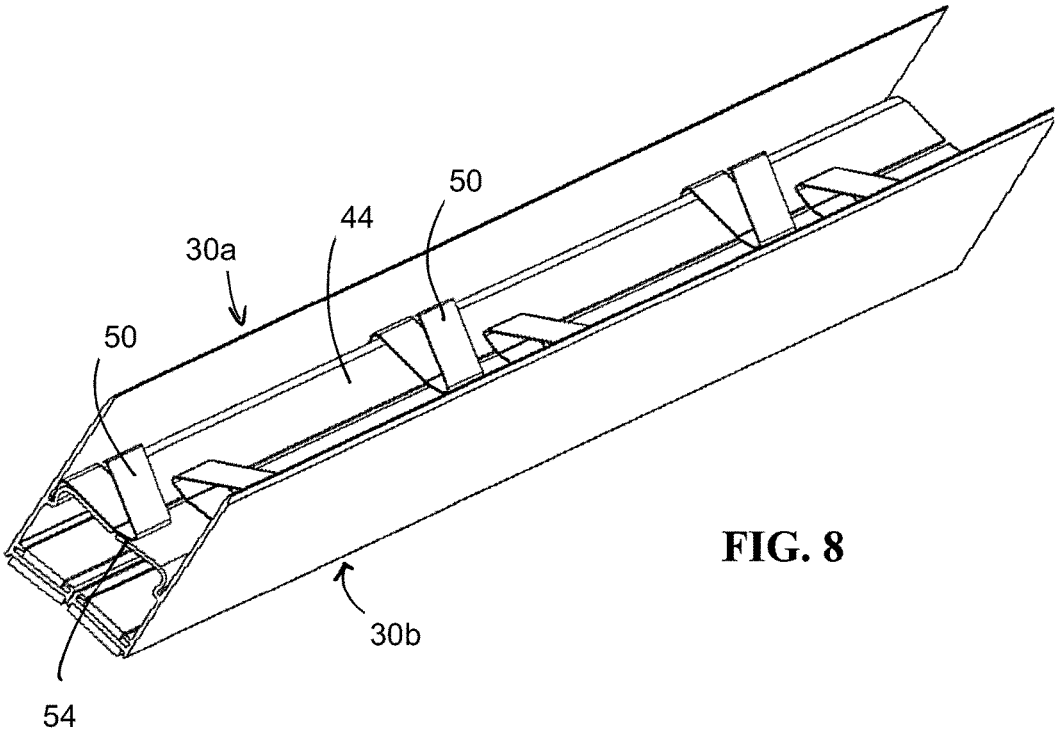
FIG. 8 is an isometric view showing two gap filler assemblies position facing one another.
Figure 9A:
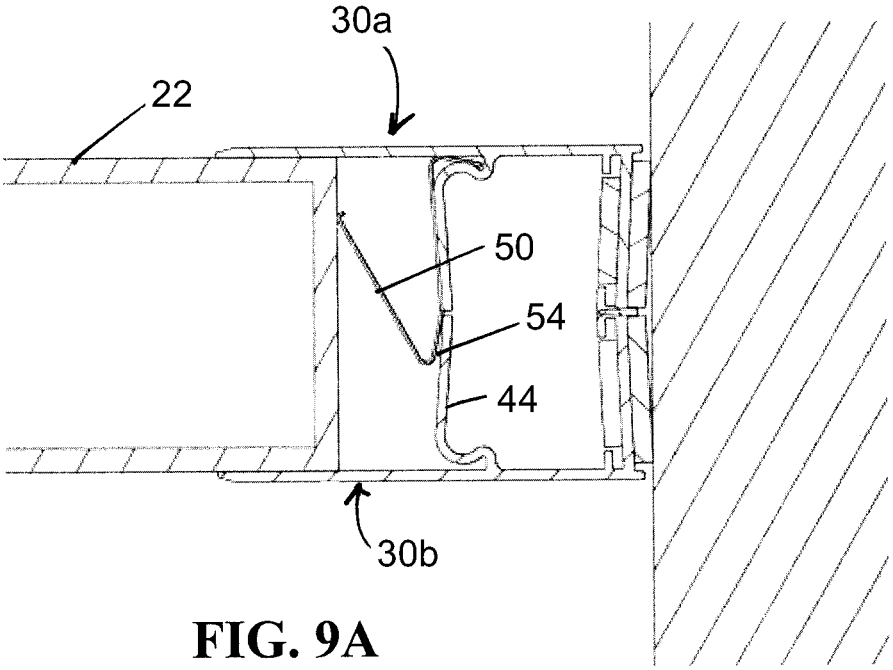
FIG. 9A is a cross sectional view of the gap filler assembly against a window mullion with the section cut to show a single spring.
Figure 9B:
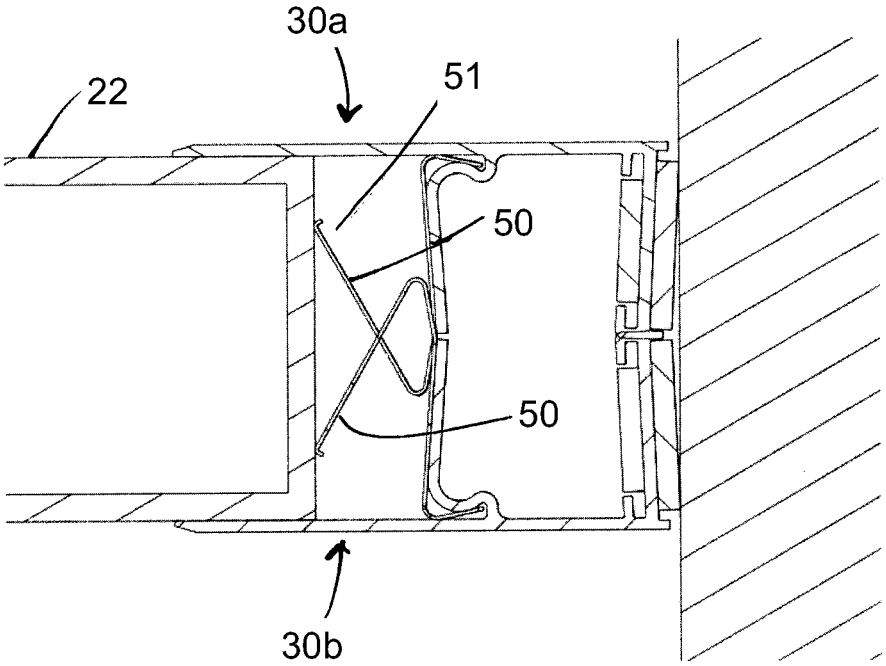
FIG. 9B is the cross sectional view of FIG. 9A, but cut to show two springs offset from one another.
Figure 10:
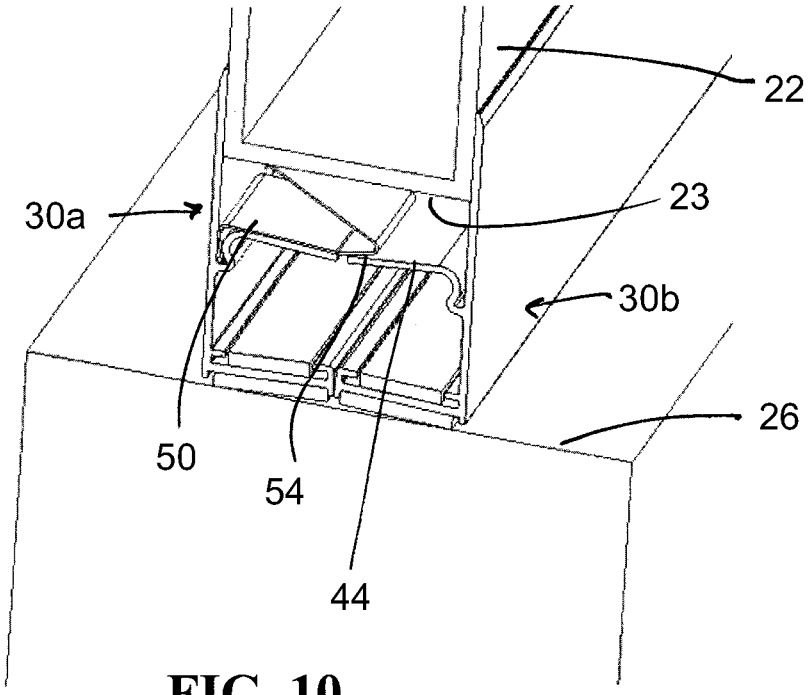
FIG. 10 is an isometric view similar to the FIG. 9A configuration.

FIGS. 8 to 10 illustrate how the FIG. 6 embodiment of leaf spring 50 interacts with the opposing spring retainer 44 when two gap filler assemblies 30*a* and 30*b* are installed over a gap to be covered. FIG. 9A is a cross section taken to show a single leaf spring 50 for clarity of illustration. FIG. 9B would be a more typical cross section where the leaf springs 50 from the two gap filler assemblies 30 are seen with the leaf springs 50 in line, one behind the other. As best seen in FIG. 9A, the slightly upturned middle segment 54 of leaf spring 50 on gap filler assembly 30*a* can easily slide over the opposing spring retainer 44 on gap filler assembly 30*b*. The isometric view of FIG. 10 perhaps shows most clearly how this upturned middle segment on the leaf springs helps ensure that spring retainer of one gap filler assembly does not interfere with the leaf spring of the opposing gap filler assembly during installation.

FIGS. 9A and 9B can also help visualize the advantage of minor leg 37 forming a slightly acute angle with major leg 43. These illustrations suggest how the point of force application by the spring 50 over the window mullion 22 moves towards the inner face 36 of the L-shaped filler member 31 as the first segment 51 of leaf spring 50 deflects angularly. The slight acute angle between major leg 34 and minor leg 37 allows the gasket 60 to proportionally deform in the projected area of the gasket 60 under the point of application of the leaf spring 50 force.

Figure 11:
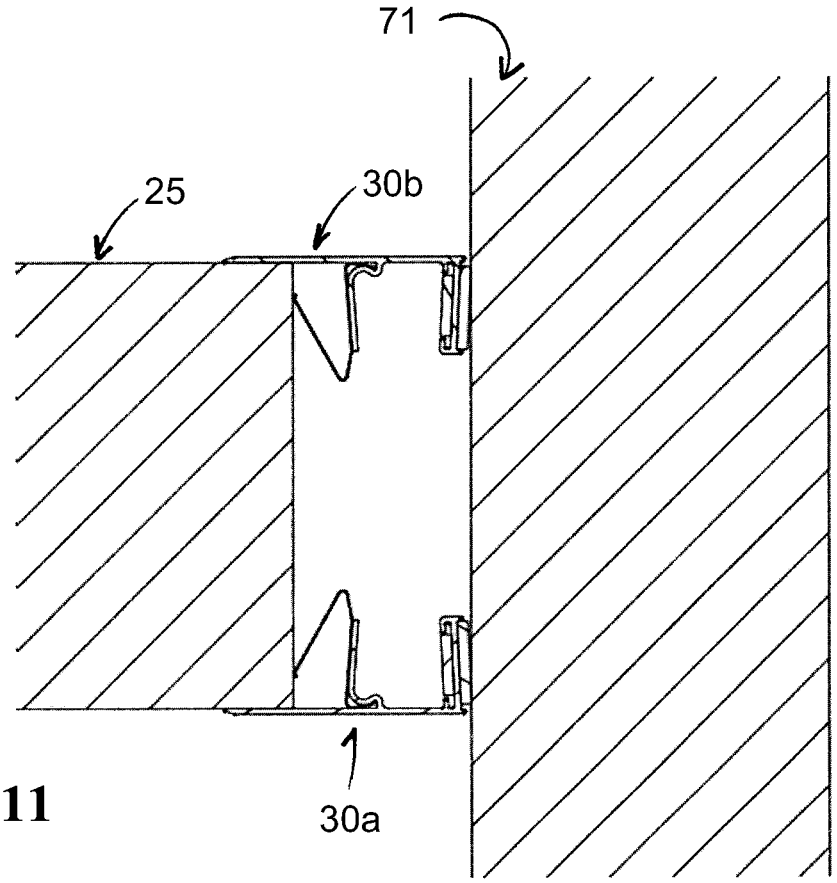
FIG. 11 is another cross sectional view showing an alternate application for the gap filler assembly where the wall gap to fill is between two walls, or a wall and glass pane.

FIG. 11 is a cross sectional view intended to represent the many different construction situations (i.e., not only window mullions) where a gap 17 could be created and the gap filler assemblies of the present invention utilized to cover such a gap. FIG. 11 suggests a partition wall 25 with a gap 17 between another "wall" 71. The wall 71 could be an exterior wall, another partition wall, a structural steel or concrete column, a glass pane, or any other building element that creates a similar gap condition. Nor does the gap have to be between vertical walls. "Wall" as used herein may include any structure tending to separate spaces in a building (including floors or ceilings) or cover structural elements (e.g., a circular column cover surrounding an unfinished structural column). A "gap between two end walls" as used herein is a gap created in any of these situations and can mean a gap between ceiling sections, a gap between two floor sections, an expansion gap between two structural sections, or a gap in a facade covering a structural member (e.g., a gap in the circular column cover referenced above). The "walls" can be any two elongated surfaces creating a gap in the construction environment.

Figure 12A:
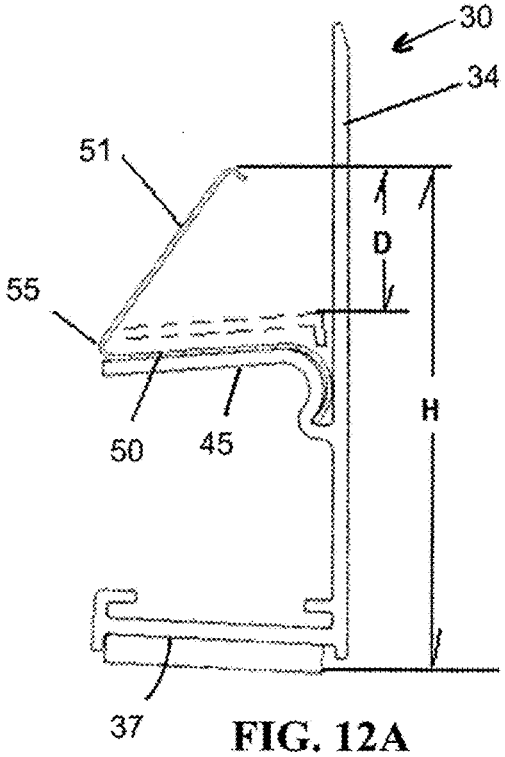
FIGS. 12A and 12B are profile views of two different sizes of the gap filler assembly.
Figure 12B:
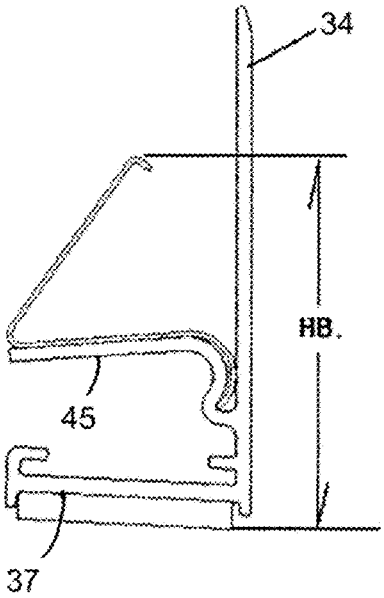

FIGS. 12A and 12B illustrate how gap filler assemblies 30 can vary in size/height. FIG. 12A shows the gap filler assembly 30 with the leaf spring 50 in two positions, relaxed and compressed by angularly deflecting the spring arm segment 51 around the bend 55. "H" denotes the dimension of the gap filler assembly 30's maximum gap width it is capable of covering. The dimension "D" denotes the maximum deflection of the spring arm 51. The gap filler assembly 30 shown in FIG. 12A will fit gaps 17 not greater in width than "H" and not smaller in width than "H" minus "D". This may be referred to as the "gap fill range" or simply "fill range." If a gap 17 is smaller than this range, then another size of gap filler assembly 30, such as shown in FIG. 12B will be used. The gap filler size shown in FIG. 12B has the same features as in FIG. 12A with a reduction only in the distance between spring support tongue 45 and minor leg 37. The dimension "HB" is equal to "H minus D" from the gap filler assembly shown in FIG. 12A. The maximum range of the leaf spring 50's deflection is denoted as "D", is determined by the length of the spring arm 51, the spring material used, and other design parameters related to spring 50.

Figure 13:
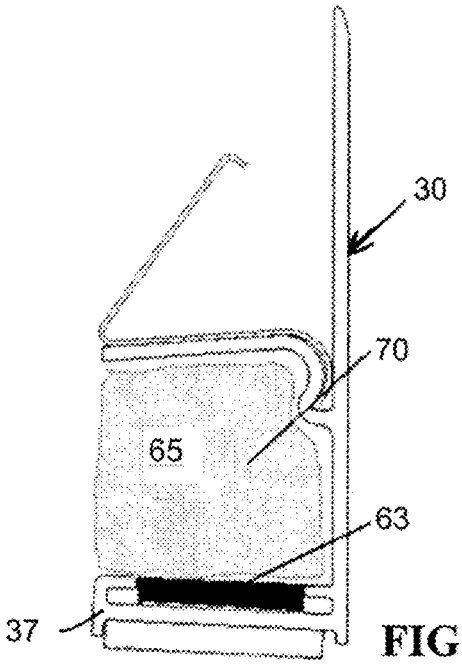
FIG. 13 is yet another cross sectional view showing the gap filler assembly of the present invention, but now including sound insulating material for further noise transmission reduction.

FIG. 13 is an illustration showing how the gap filler assembly 30 could have the space 65 between spring support tongue 45 and minor leg 37 filled with sound proofing insulation 70, such as strips of mass loaded vinyl similar to that used as vibration dampening material 63. These sound proofing/vibration dampening materials will act to further reduce the sound transmission through the space formed by the gap 17.

Figure 14:
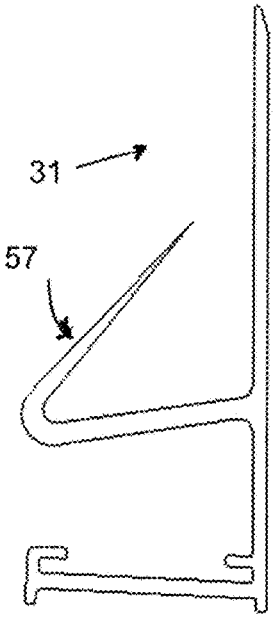
FIG. 14 illustrates an alternative L-shaped filler member where the spring leaf is an integral part of the extrusion.

FIG. 14 illustrates a L-shaped filler member 31 which could have an integrally formed leaf spring 50 as part of the extruded member if the extruded material is sufficiently flexible, e.g., such as a thermoplastic. In this embodiment, the leaf spring and spring retainer seen in previous embodiments are combined to form a continuous flexible spring/support structure 57. Nevertheless, this spring/support structure 57 should still be considered a "leaf spring" for purposes of the present invention.

Many modifications and other embodiments of the present invention will come to mind to one skilled in the art having the benefit of the teaching presented in the foregoing description and associated drawings. For example, although the figures show an L-shaped filler member having a minor leg shorter to than the major leg, there could be embodiments where the legs have an equal length. Similarly, while the figures show use of a leaf spring, other spring types could be employed, including springs formed of a block of resilient elastic material. Therefore, it is to be understood that the invention is not limited to the specific embodiments disclosed, and that modifications and other embodiments are intended to be included within the scope of the appended claims. Although specific terms are employed here in, they are used in a generic and descriptive sense and not for purposes of limitations. The term "about" as used herein will typically mean a numerical value which is approximate and whose small variation would not significantly affect the practice of the disclosed embodiments. Where a numerical limitation is used, unless indicated otherwise by the context, "about" means the numerical value can vary by +/−5%, +/−10%, or in certain embodiments +/−15%, or possibly as much as +/−20%. Similarly, the term "substantially" will typically mean at least 85% to 99% of the characteristic modified by the term. For example, "substantially all" will mean at least 85%, at least 90%, or at least 95%, etc.

The invention claimed is:

1. A gap filler assembly, the gap filler assembly comprising:

(a) an elongated L-shaped filler member having (i) a major leg with a first and second end, and (ii) a minor leg on an interior side of the major leg and extending approximately perpendicularly from the first end of the major leg;

(b) a spring retainer positioned on the interior side of the major leg at a position between the first and second end of the major leg;

(c) a leaf spring held on the spring retainer, the leaf spring having a first segment extending away from the interior side of the major leg, a second segment extending back toward the interior side, and a curved segment positioned between the first segment and second segment; and (d) a gasket positioned on an exterior side of the minor leg.

2. The gap filler assembly of claim 1, wherein an interior side of the minor leg includes opposing retaining tabs extending partially toward a center of the minor leg to form a splice pocket.

3. The gap filler assembly of claim 2, wherein a vibration dampening material is positioned at least partially between the retaining tabs.

4. The gap filler assembly of claim 3, wherein the dampening material is a mass loaded vinyl.

5. The gap filler assembly of claim 1, wherein the gasket is formed of a resilient material adhered to the minor leg.

6. The gap filler assembly of claim 5, wherein the gasket is formed of a polyurethane foam.

7. The gap filler assembly of claim 1, wherein the major leg, minor leg, and spring retainer are an integrally formed section of extruded material.

8. The gap filler assembly of claim 7, wherein the extruded material is aluminum or a thermoplastic.

9. The gap filler assembly of claim 1, wherein the exterior side of the minor leg includes two outwardly extending tabs between which the gasket is seated.

10. The gap filler assembly of claim 1, wherein the minor leg does not have a second, opposing major leg attached to it.

11. The gap filler assembly of claim 1, wherein the major leg has a Length L extending from the minor leg, and the spring retainer is positioned at between 10% and 50% of L.

12. The gap filler assembly of claim 1, wherein the major leg extends past the leaf spring when the leaf spring is in an uncompressed state.

13. The gap filler assembly of claim 1, wherein a longitudinal axis of the major leg and a longitudinal axis of the minor leg form an interior angle of between 80° and 87°.

14. A method of covering an opening between two structures comprising the steps of:

(a) providing a first gap filler assembly comprising:

(i) an elongated L-shaped filler member having (1) a major leg with a first and second end, and (2) a minor leg on an interior side of the major leg and extending approximately perpendicularly from approximately the first end of the major leg;

(ii) a spring retainer positioned on the interior side of the major leg;

(iii) a leaf spring held on the spring retainer, the leaf spring having a first segment extending away from the interior side of the major leg, a second segment extending back toward the interior side, and a curved segment positioned between the first segment and second segment; and (iv) a gasket positioned on an exterior side of the minor leg;

(b) positioning the first gap filler assembly over a first side of the opening such that the leaf spring is compressed by a face of a first structure while the gasket on the minor leg engages a face of a second structure.

15. The method of claim 14, wherein the first structure comprises a window mullion and the second structure comprises an adjacent partition wall.

16. The method of claim 15, further positioning a second gap filler assembly substantially identical to the first gap filler assembly over a second side of the opening.

17. The method of claim 16, wherein a plurality of leaf springs are positioned along a length of each of the first and second gap filler assemblies and the leaf springs of the respective gap filler assemblies are offset from one another.

18. The method of claim 17, wherein the leaf springs of the first gap filler assembly overlap the spring retainer of the second gap filler assembly.

* * * * *